US008641584B2

(12) United States Patent
Jang

(10) Patent No.: US 8,641,584 B2
(45) Date of Patent: Feb. 4, 2014

(54) APPARATUS FOR KICKING EXERCISE

(75) Inventor: Hun Il Jang, Suwon (KR)

(73) Assignee: Eorg. Co., Ltd (KR)

( * ) Notice: Subject to any disclaimer, the term of this patent is extended or adjusted under 35 U.S.C. 154(b) by 210 days.

(21) Appl. No.: 13/297,526

(22) Filed: Nov. 16, 2011

(65) Prior Publication Data

US 2012/0065032 A1 Mar. 15, 2012

Related U.S. Application Data

(63) Continuation of application No. PCT/KR2009/003152, filed on Jun. 11, 2009.

(51) Int. Cl.
*A63B 69/34* (2006.01)

(52) U.S. Cl.
USPC ..... 482/83; 482/84; 482/86; 482/87; 482/90

(58) Field of Classification Search
USPC ..... 482/54, 62, 83–90; 473/441–445; 273/440.1
See application file for complete search history.

(56) References Cited

U.S. PATENT DOCUMENTS

| | | | | |
|---|---|---|---|---|
| 2,558,081 | A * | 6/1951 | Gardenhour | 473/445 |
| 4,416,293 | A * | 11/1983 | Anderson et al. | 600/595 |
| 4,565,366 | A * | 1/1986 | Struss | 482/84 |
| 6,093,119 | A * | 7/2000 | Tipton | 473/438 |
| 6,217,490 | B1 * | 4/2001 | Wurtak | 482/83 |
| 7,063,647 | B2 * | 6/2006 | Harney et al. | 482/54 |
| 8,025,612 | B1 * | 9/2011 | Buzzanco et al. | 482/83 |
| 2002/0160889 | A1 * | 10/2002 | Lederman | 482/83 |

FOREIGN PATENT DOCUMENTS

| | | | |
|---|---|---|---|
| JP | 07-044436 | U | 11/1995 |
| JP | 03-091844 | U | 11/2002 |
| KR | 10-0148427 | B1 | 8/1998 |
| KR | 20-0395408 | Y1 | 9/2005 |
| KR | 20-0399840 | Y1 | 10/2005 |
| KR | 10-0635383 | B1 | 10/2006 |
| KR | 20060112549 | A | 11/2006 |
| KR | 20080038935 | A | 5/2008 |

OTHER PUBLICATIONS

International Search Report (PCT/KR2009/003152).

* cited by examiner

*Primary Examiner* — Loan Thanh
*Assistant Examiner* — Nyca T Nguyen
(74) *Attorney, Agent, or Firm* — Park & Associates IP Law, P.C.

(57) ABSTRACT

The present invention relates to an apparatus for kicking exercise, and more specifically, to an apparatus for kicking exercise which includes a plurality of hitting parts coupled to a body which is fastened to a gravity center frame or a running machine to enable martial arts exercise such as taekwondo, karate, kickboxing and the like, thereby enabling a user to do martial arts exercise by hitting and kicking the hitting parts with the hand and foot.

7 Claims, 8 Drawing Sheets

APPARATUS FOR KICKING EXERCISE

REFERENCE TO RELATED APPLICATIONS

This is a continuation of pending International Patent Application PCT/KR2009/003152 filed on Jun. 11, 2009, which designates the United States and claims priority of Korean Patent Application No. 10-2009-0046746 filed on May 28, 2009, the entire contents of which are incorporated herein by reference.

FIELD OF THE INVENTION

The present invention relates to a kick exercise apparatus, and more particularly, to a kick exercise apparatus in which a plurality of striking portions are coupled to a body fastened to a gravity center frame or a treadmill that can move a position in order to exercise martial arts such as Taekwondo, karate, and kick boxing and that can exercise martial arts as a user strikes a striking portion using hand and feet.

BACKGROUND OF THE INVENTION

In general, when exercising martial arts such as Taekwondo, punch technology using hands and kick technology using feet are exercised by punching or kicking a sandbag hung from a ceiling, and when exercising actual Taekwondo technology such as competition, a pair of team joined with two persons competes. Exercise of punch using hands and kick using feet is very monotonous and there is a danger of an injury in competition, and when exercising punching or kicking, in order to improve a reflex action of a user and accuracy of punching or kicking, while a master holds a scoop type mitt and changes a position of the mitt, a trainee exercises punching or kicking, but there is a defect that the trainee alone cannot exercise punching or kicking.

Nowadays, in order to solve the above defect, by installing a plurality of arms in a pillar and fixing a scoop type mitt to the arms, a trainee alone can exercise punching or kicking, but because a position of several scoop type mitts cannot be changed, there is a defect that an exercise effect is not appropriately exhibited.

Further, Korean Unexamined Patent Application Publication No. 94-27953 applied by the present applicant has solved the defects, but elastic strength of a scoop type mitt is weak, it is difficult to install a sensor in the scoop type mitt, a striking position of the trunk is inaccurate, and direction lamps are scattered and installed and thus concentration of a trainee is deteriorated.

Further, martial arts such as Taekwondo, karate, and kick boxing variously use technology of punching with hands or technology of kicking with feet. Exercise of martial arts using hand and feet is performed by punching or kicking a sandbag hung from the ceiling. Further, when exercising actual technology such as competition, a pair of team joined with two persons is competed, but exercise of punching or kicking is very monotonous, and in a process of competing, by striking a body of another party, the another party may be injured. In a process of exercising technology of punching or kicking, in order to improve a reflex action of a user and accuracy of striking, while a master holds a scoop type mitt in both hands and changes a position to the right side, the left side, the upper side, and the lower side, technology of punching or kicking is exercised. However, it is impossible to individually perform such exercise, and a supporter to hold the scoop type mitt is required.

In order to solve the above defect, by installing a plurality of arms in a pillar and fixing a scoop type mitt to the arms, a trainee alone can exercise punching or kicking, but because a position of several scoop type mitts cannot be changed, there is a defect that an exercise effect is not appropriately improved.

In order to solve the problem, a martial arts exercise apparatus (Korean Patent No. 0148427) in which a pillar for fastening to the ceiling and the bottom by a screw is provided and in which a scoop type mitt and a three surface mitt are coupled to the pillar and thus can perform individual martial arts exercise is suggested.

However, in a conventional martial arts exercise apparatus, elastic strength of the scoop type mitt is very weak and a striking portion of the trunk is inaccurate. Further, it is very difficult to install the apparatus, and after the apparatus is installed, the apparatus cannot be moved.

After holes are formed in the ceiling and the floor and a height of a support plate fastened to an upper part and a lower part of the pillar is adjusted, volts are inserted and are fastened to holes formed in the ceiling and the floor. In this case, holes should be formed at the ceiling and the floor to correspond to holes of the support plate, and the apparatus having a considerable weight should be supported. A height of the support plate is adjusted by a screw thread formed in the pillar, but when exercising martial arts, the support plate is moved by an external force applied to the apparatus and thus a problem occurs where a fastening portion coupled to the ceiling and the floor is separated.

Further, in order to install the pillar, a height of the ceiling and the floor should be appropriate, and if a height of the ceiling and the floor is small, the pillar cannot be installed, and if a height of the ceiling and the floor is too large, after the apparatus is installed, a force for supporting the apparatus is low and thus a problem occurs where the apparatus is easily damaged and is separated occurs. At a location at which the ceiling and the floor are made of wood, the apparatus cannot be installed, and at a location at which the ceiling and the floor are made of marble, it is very difficult to form holes at the ceiling and the floor. Due to the above problems, it is difficult to move and install the apparatus from a location at which the apparatus is first installed to another location. Therefore, in a martial arts training hall for exercising martial arts, the apparatus is required, but it is very difficult to install the apparatus, and once the apparatus is installed, it is impossible to move the apparatus and thus it is not easy to install the apparatus.

SUMMARY OF THE INVENTION

The present invention has been made in view of the above problems, and provides a kick exercise apparatus that can be conveniently installed, and moved around indoors and be installed at a new location.

The present invention further provides a kick exercise apparatus that can be used to improve martial arts of a user by recognizing the user's ability through recorded data and adjusting exercise strength of the user in the process of striking a plurality of striking portions.

The present invention further provides a kick exercise apparatus that can prevent a user's injury as an impact absorption member is coupled to a striking portion.

The present invention further provides a kick exercise apparatus by which a user can individually exercise various striking technology as a plurality of striking portions are coupled to a front side, a side surface, an upper part, and a lower part of a body.

In accordance with an aspect of the present invention, a kick exercise apparatus includes: a body formed with a vertically installed rectangular parallelepiped frame; an upper cover and a lower cover for protecting the body at an upper part and a lower part of the body; striking portions installed at a front side of the body and at an upper part and a lower part of both sides of the body; and an impact absorption member fixedly installed at the outside of a plate of the striking portion, wherein one end of moving portion of a straight shaft in which a rack gear is formed is coupled to an inner center of the plate, one end of a guide plate in which a long hole is formed is coupled to a hinge rib of one of both sides of an upper part and a lower part of the plate, the long hole of the guide plate is inserted into and is moveably coupled to a guide rib of the body, the straight shaft is inserted into and coupled to a bushing coupled to the body, the rack gear is installed to engage with a pinion gear of a rotation shaft installed in the body, an elastic spring is installed around the straight shaft between the body and the plate, and a gravity center frame is coupled to a rear surface of the body.

A sensor may be fixedly installed by a fixing volt at one side of the body in which the rotation shaft is installed.

The sensor may be connected to a controller, and the controller may be connected to a display unit and an input unit, and in the input unit, various data of a time, a striking speed, the number of times of striking, a weight upon striking, a time change amount upon striking, an impact amount, and a impact force are set, and the display unit distinguishably displays measured values of striking applied to the striking portion.

In accordance with another aspect of the present invention, a kick exercise apparatus includes: a body formed with a vertically installed rectangular parallelepiped frame; an upper cover and a lower cover for protecting the body at an upper part and a lower part of the body; striking portions installed at a front side of the body and an upper part and a lower part of both sides of the body; and an impact absorption member fixedly installed at the outside of a plate of the striking portion, wherein one end of moving portion of a straight shaft in which a rack gear is formed is coupled to an inner center of the plate, one end of a guide plate in which a long hole is formed is coupled to a hinge rib of one of both sides of an upper part and a lower part of the plate, the long hole of the guide plate is inserted into and is moveably coupled to a guide rib of the body, the straight shaft is inserted into and coupled to a bushing coupled to the body, the rack gear is installed to engage with a pinion gear of a rotation shaft installed in the body, an elastic spring is installed around the straight shaft between the body and the plate, and a rear frame of the body is coupled to a front frame of a treadmill.

A sensor may be fixedly installed by a fixing volt at one side of the body in which the rotation shaft is installed, the sensor may be connected to a controller, and the controller may be connected to a display unit and an input unit, and in the input unit, various data of a time, a striking speed, the number of times of striking, a weight upon striking, a time change amount upon striking, an impact amount, and a impact force are set, and the display unit distinguishably displays measured values of striking applied to the striking portion.

At the left side of the treadmill, a handle having an angle adjustment button in an upper part of the treadmill may be installed, a vertical shaft may be coupled to a lower part of the handle, a spring may be installed between the vertical shaft and a handle portion, and at the right side of the treadmill, a handle having a treadmill on/off button and a front-rear movement button at an upper part of the trademill may be installed, a vertical shaft may be coupled to a lower part of the handle, and a spring may be installed between the vertical shaft and the handle portion.

An upper rail may be installed in an upper part of the treadmill, a roller of the support shaft may be inserted into a guide groove of the upper rail, a ring may be installed at both sides of a support plate coupled to the support shaft, and a safety line may be connected to the ring and may be connected to both sides of a protective vest.

As described above, according to the present invention, a kick exercise apparatus can be conveniently installed, and moved around indoors and be installed at a new location.

Further, when striking a plurality of striking portions, a user's ability can be recognized through data and thus an exercising level can be adjusted, whereby a technology level of martial arts can be improved.

Further, as an impact absorption member is coupled to the striking portion, a user's injury can be prevented.

Further, as the striking portions are coupled to a front side of a body and an upper part and a lower part of a side surface of the body, various kick technology can be performed and a user alone can exercise various technology.

Further, as sensors connected to a controller are provided within the body, strength and a striking speed of an external force applied to the striking portion can be easily recognized through a display unit.

Further, a time, a striking speed, the number of times of striking, a weight upon striking, a time change amount upon striking, an impact amount, and an impact force are input and set through an input unit, and the display unit displays strength, a striking speed, the number of times of striking, a weight upon striking, a time change amount upon striking, an impact amount, and an impact force of an external force applied to a striking portion within a preset time. Therefore, a user can perform a scheduled exercise with reference to preset data.

Further, a user alone can freely exercise punching technology and kick technology of martial arts.

DESCRIPTION OF REFERENCES NUMERALS INDICATING PRIMARY ELEMENTS IN THE DRAWINGS

Figure 1:
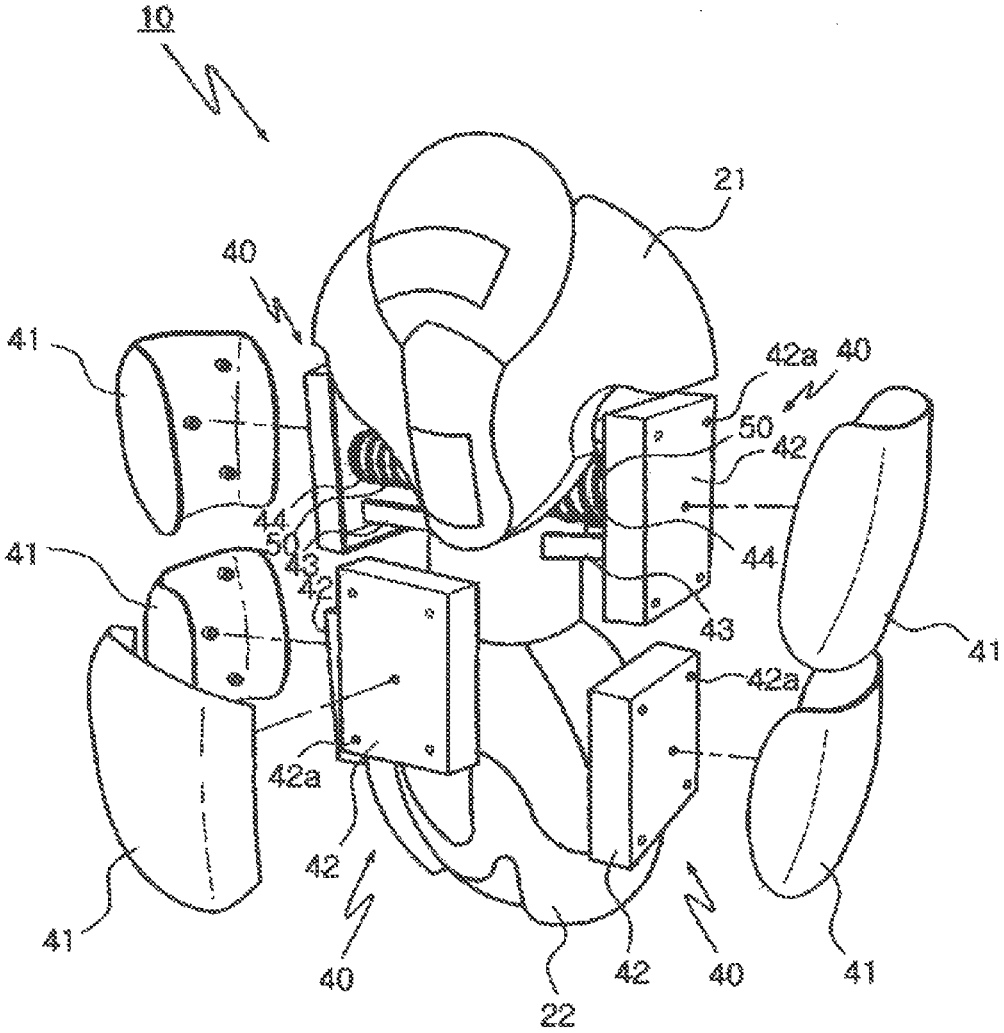
FIG. 1 is an exploded perspective view illustrating a kick exercise apparatus according to an exemplary embodiment of the present invention.

10: kick exercise apparatus
21: upper cover
22: lower cover
30: body
31: guide rib
32: bushing
40: striking portion
41: impact absorption member
42: plate
42*a*: fixing hole
42*b*: hinge rib
43: guide plate
43*a*: long hole
44: straight shaft
45: rack gear
50: spring
60: rotation shaft
61: pinion gear
70: sensor
71: fixing volt
100: gravity center frame
200: treadmill
201: front frame
202: floor frame
203: upper rail
204: rotation belt

DETAILED DESCRIPTION OF THE INVENTION

Hereinafter, an exemplary embodiment according to the present invention will be described in detail with reference to the attached drawings. However, as those skilled in the art would realize, the described embodiments may be modified in various different ways, all without departing from the spirit or scope of the present invention.

Figure 2:
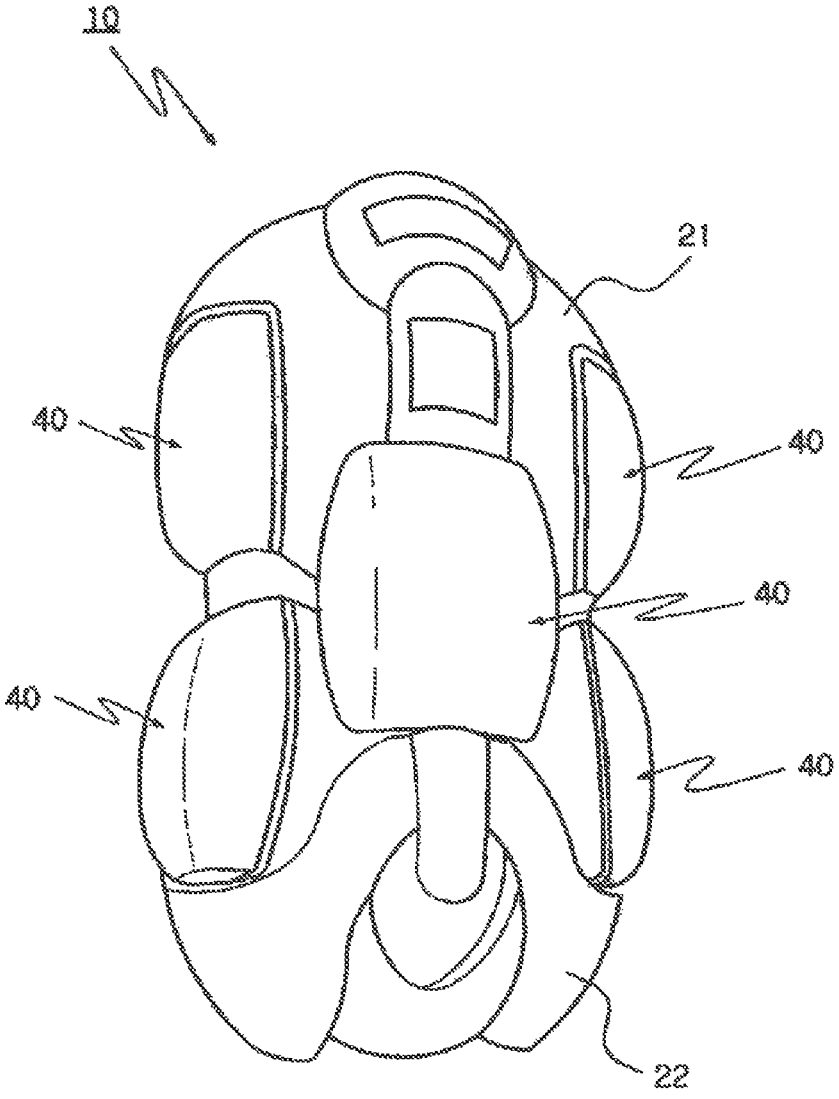
FIG. 2 is a perspective view illustrating a kick exercise apparatus according to an exemplary embodiment of the present invention.
Figure 3:
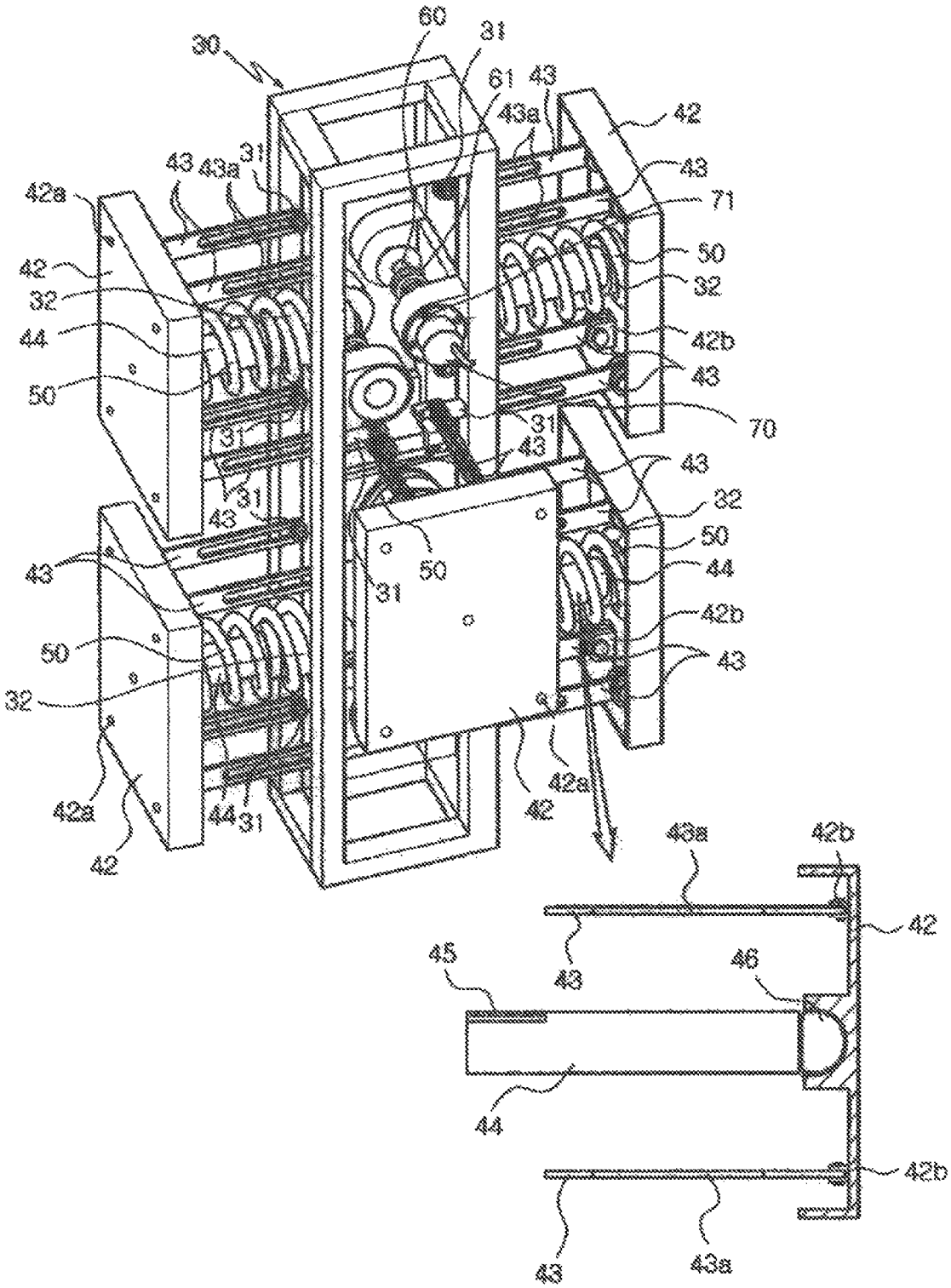
FIG. 3 is a perspective view illustrating an internal body of a kick exercise apparatus according to an exemplary embodiment of the present invention.
Figure 4:
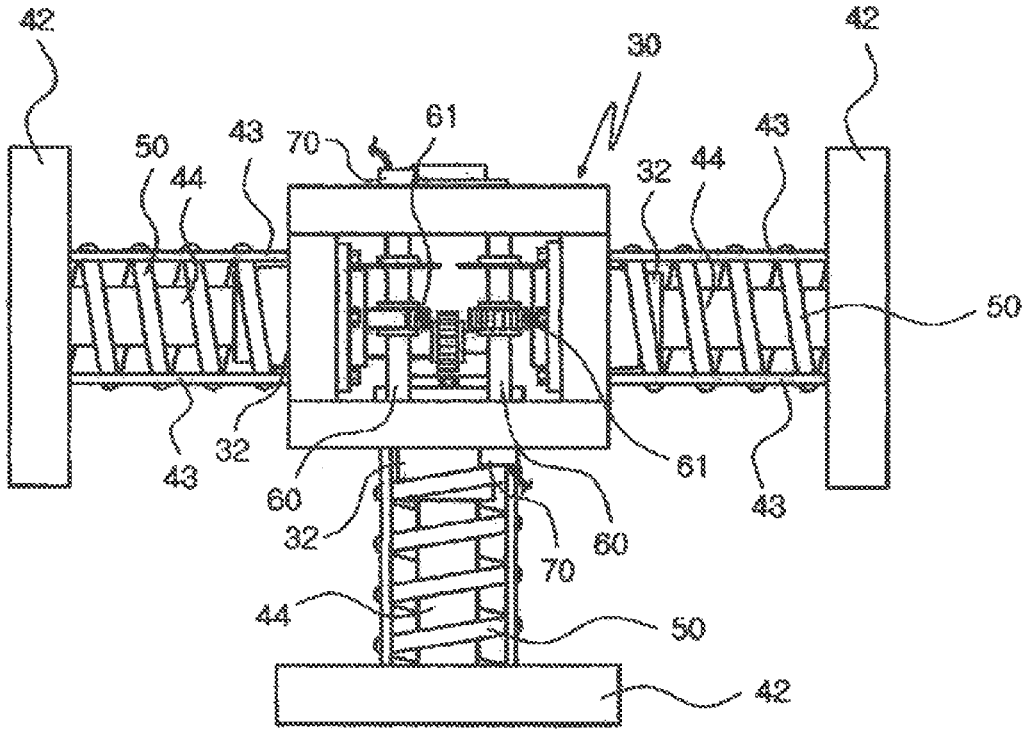
FIG. 4 is a top plan view illustrating an internal body of a kick exercise apparatus according to an exemplary embodiment of the present invention.
Figure 5:
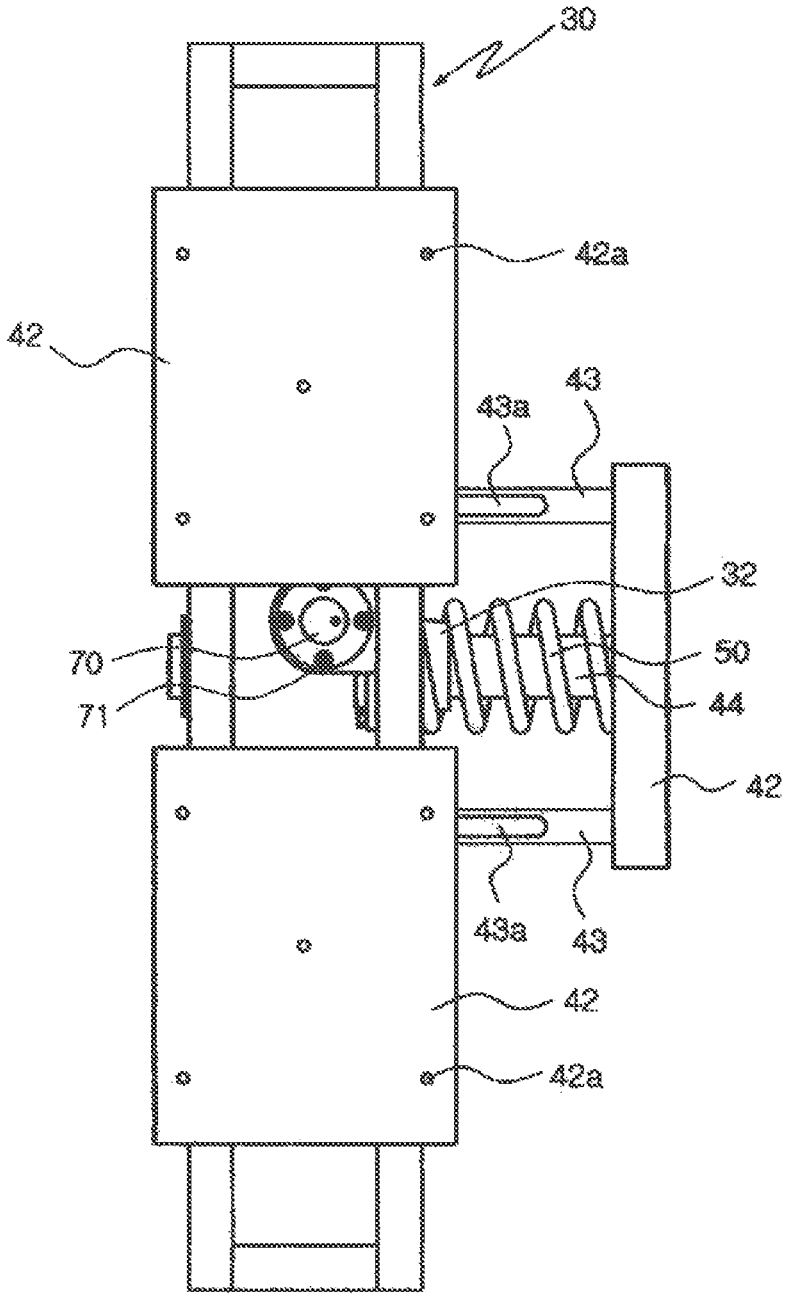
FIG. 5 is a side view illustrating an internal body of a kick exercise apparatus according to an exemplary embodiment of the present invention.
Figure 6:
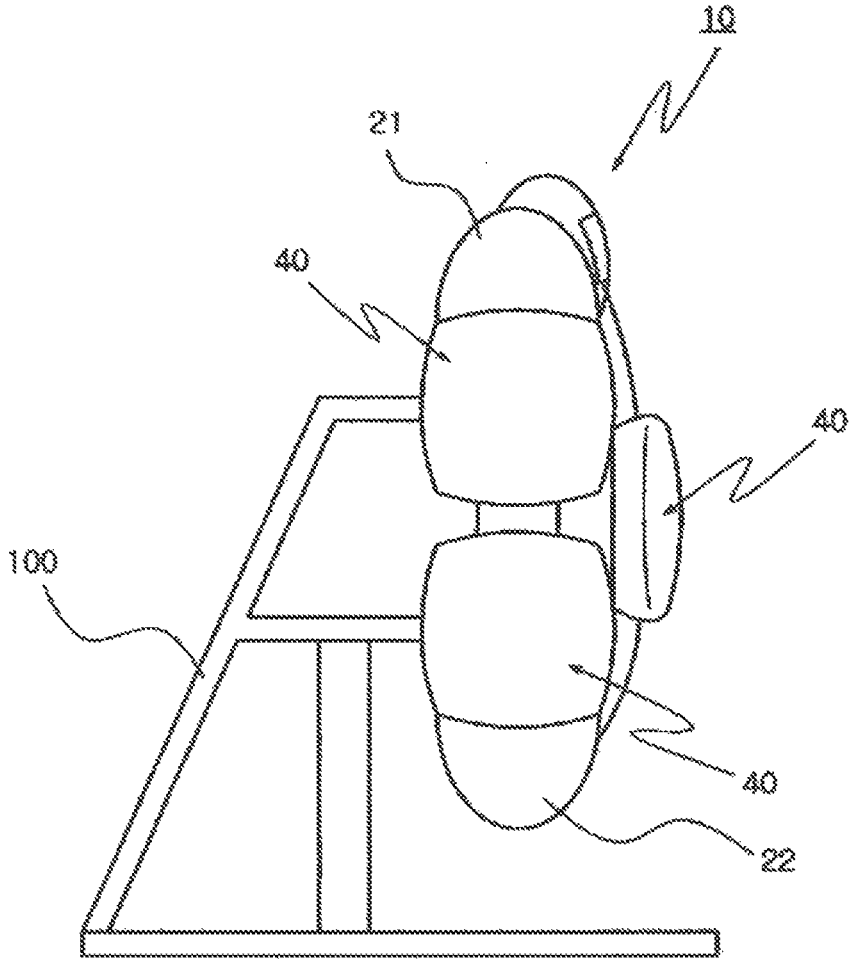
FIG. 6 is a diagram illustrating a state in which a kick exercise apparatus according to an exemplary embodiment of the present invention is installed in a fixing frame (gravity center frame)
Figure 7:
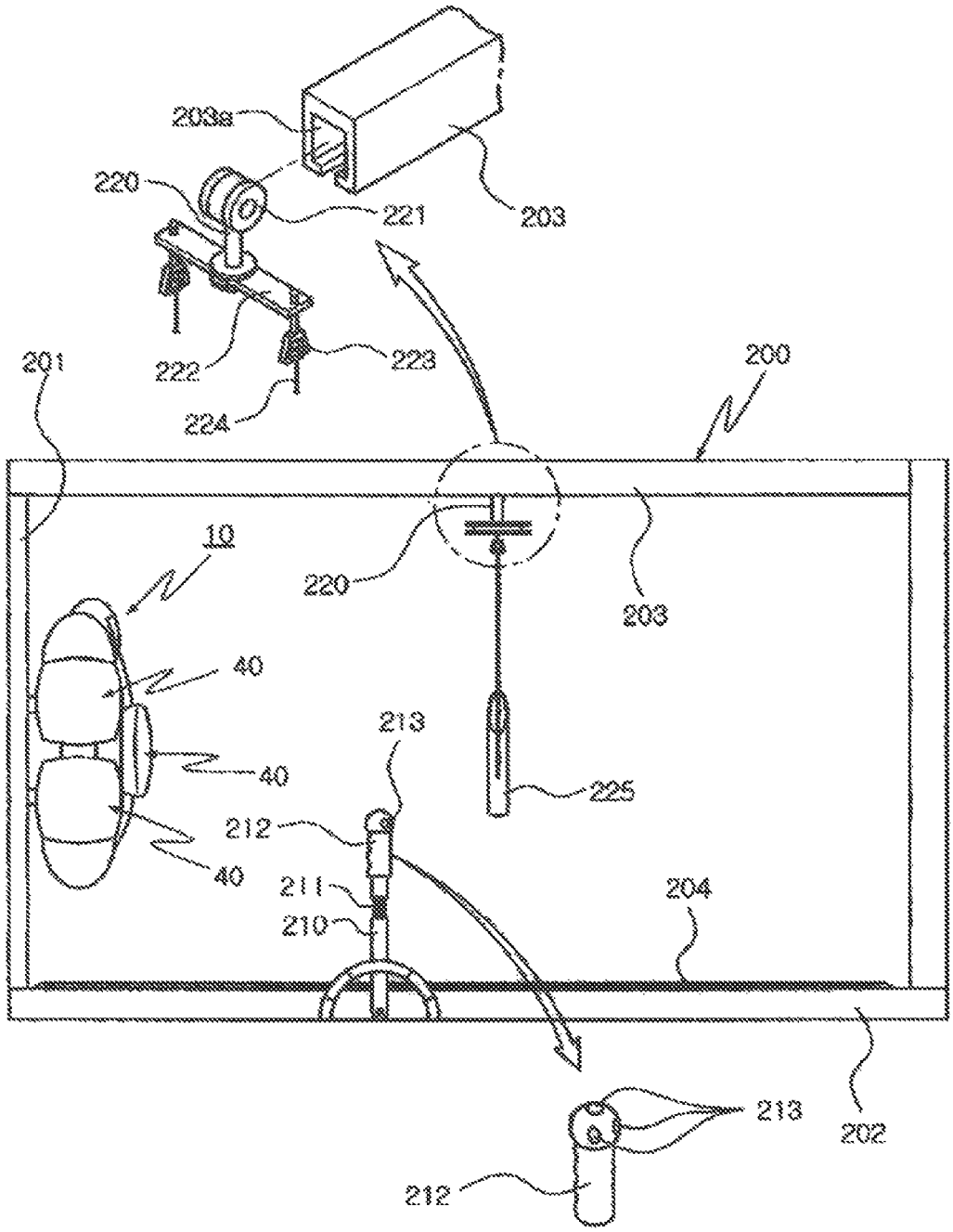
FIG. 7 is a left side view illustrating a state in which a kick exercise apparatus according to an exemplary embodiment of the present invention is installed in a treadmill.
Figure 8:
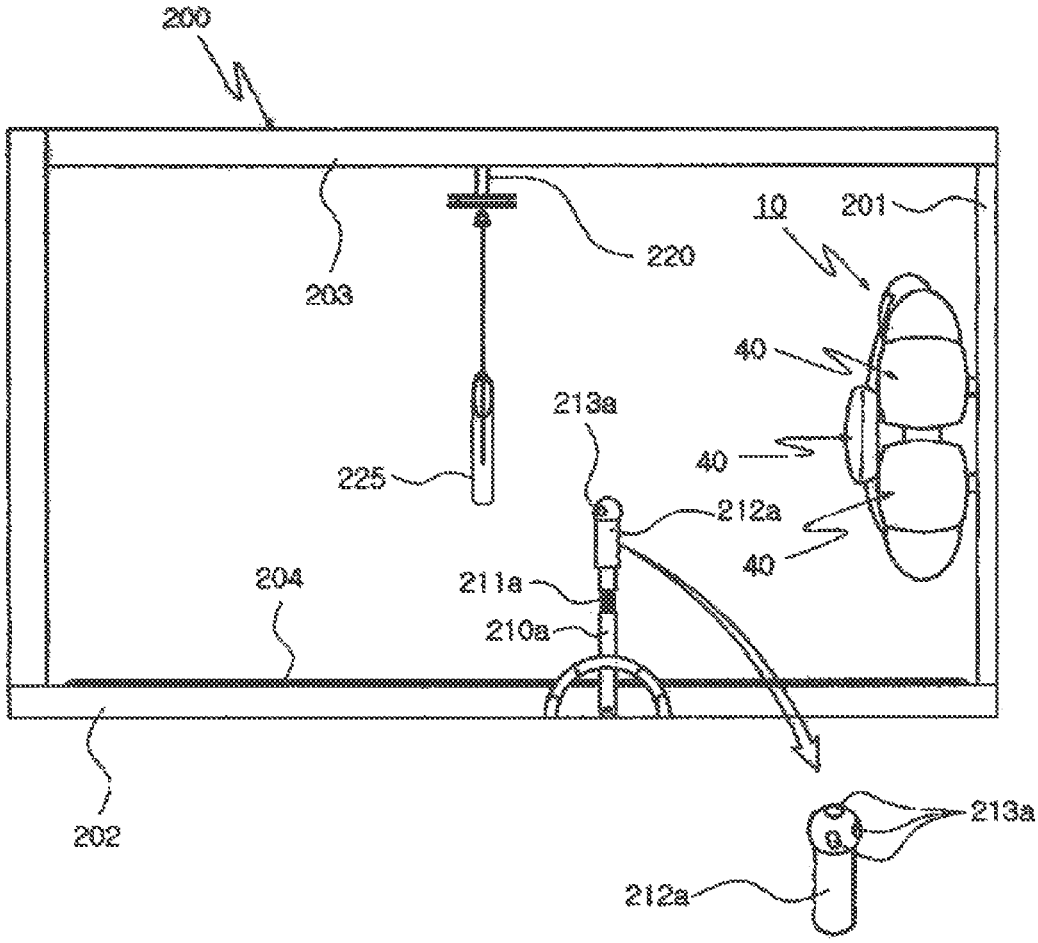
FIG. 8 is a right side view illustrating a state in which a kick exercise apparatus according to an exemplary embodiment of the present invention is installed in a treadmill.

FIG. 1 is an exploded perspective view illustrating a kick exercise apparatus according to an exemplary embodiment of the present invention, FIG. 2 is a perspective view illustrating a kick exercise apparatus according to an exemplary embodiment of the present invention, FIG. 3 is a perspective view illustrating an internal body of a kick exercise apparatus according to an exemplary embodiment of the present invention, FIG. 4 is a top plan view illustrating an internal body of a kick exercise apparatus according to an exemplary embodiment of the present invention, FIG. 5 is a side view illustrating an internal body of a kick exercise apparatus according to an exemplary embodiment of the present invention, FIG. 6 is a diagram illustrating a state in which a kick exercise apparatus according to an exemplary embodiment of the present invention is installed in a fixing frame, FIG. 7 is a left side view illustrating a state in which a kick exercise apparatus according to an exemplary embodiment of the present invention is installed in a treadmill, and FIG. 8 is a right side view illustrating a state in which a kick exercise apparatus according to an exemplary embodiment of the present invention is installed in a treadmill.

A kick exercise apparatus according to an exemplary embodiment of the present invention will be described with reference to FIGS. 1 to 8.

The present invention relates to a kick exercise apparatus in which a plurality of striking portions are coupled to a body fastened to a gravity center frame or a treadmill that can move a position in order for a user to exercise martial arts such as Taekwondo, karate, and kick boxing and to a kick exercise apparatus which can be used for a user to exercise martial arts with a method in which a user strikes a striking portion using hands and feet.

Referring to FIGS. 1 to 8, in a kick exercise apparatus 10 according to an exemplary embodiment of the present invention includes a body 30 formed with a vertically installed rectangular parallelepiped frame and an upper cover 21 and a lower cover 22 for protecting the body 30 at an upper part and a lower part of the body 30.

The kick exercise apparatus 10 further includes a striking portion 40 installed at a front side of the body 30 and at an upper part and a lower part of both sides of the body 30 and an impact absorption member 41 fixedly installed at the outside of a plate 42 of the striking portion 40.

The impact absorption member 41 is coupled by a volt to a fixing hole 42*a* of the plate 42, and a hook is formed at the inside of the impact absorption member 41, and the impact absorption member 41 is coupled to the fixing hole 42*a* of the plate 42 using the hook.

One end of moving portion 46 of a straight shaft 44 in which a rack gear 45 is formed is coupled to an inner center of the plate 42, and one end of a guide plate 43 in which a long hole 43*a* is formed is coupled to a hinge rib 42*b* of one of both sides of an upper part and a lower part of the plate 42, and the long hole 43*a* of the guide plate 43 is inserted into and is moveably coupled to a guide rib 31 of the body 30.

The straight shaft 44 is inserted into and coupled to a bushing 32 coupled to the body 30, and the rack gear 45 is installed to engage with a pinion gear 61 of a rotation shaft 60 installed in the body 30.

An elastic spring 50 is installed around the straight shaft 44 between the body 30 and the plate 42, and a gravity center frame 100 or a front frame 201 of a treadmill 200 is coupled to a rear frame of the body 30.

A sensor 70 is fixedly installed by a fixing volt 71 at one side of the body 30 in which the rotation shaft 60 is installed.

The sensor 70 is connected to a controller (not shown), and the controller is connected to a display unit and an input unit, and in the input unit, various data of a time, a striking speed, the number of times of striking, a weight upon striking, a time change amount upon striking, an impact amount, and a impact force are set, and the display unit distinguishably displays measured values of striking applied to the striking portion. The display unit is separately formed and is connected to the controller through a wired or wireless means.

A rotation belt 204 is installed at the inside of a floor frame 202 of the treadmill 200, a handle in which an angle adjustment button 213 is installed in an upper part thereof is installed at the left side of the treadmill 200, a vertical shaft 210 is coupled to a lower side of the handle, and a spring 211 is installed between the vertical shaft 210 and a handle portion 212.

At the right side of the treadmill 200, a handle having a treadmill on/off button and a front-rear movement button 213*a* at an upper part thereof is installed, a vertical shaft 210*a* is coupled to a lower part of the handle, and a spring 211*a* is installed between the vertical shaft 210*a* and the handle portion 212*a*.

An upper rail 203 is installed in an upper part of the treadmill 200, a roller 221 of a support shaft 220 is inserted into a guide groove 203*a* of the upper rail 203, a ring 223 is installed at both sides of a support plate 222 coupled to the support shaft 220, and a safety line 224 is connected to the ring 223 and is connected to both sides of a protective vest 225.

The plate 42 of a light metal material such as aluminum, or of a synthetic resin having high strength is provided in the striking portion 40. The impact absorption member 41 is coupled to the plate 42.

The gravity center member 100 may be welded by disposing a connecting piece in the body 30 or may be fastened by a bolt and a nut to the body 30.

The kick exercise apparatus 10 can be moved and installed according to a location and position to install.

When the impact absorption member 41 of the striking portion 40 is struck by punch or kick, the plate 42 moves inwardly and the central straight shaft 44 moves, and the pinion gear 61 installed in the rotation shaft 60 rotates by the rack gear 45.

In this case, the sensor 70 fixed to one side of the body 30 by the fixing volt 71 detects a rotation speed of the rotation shaft 60 and sends the rotation speed to a general display unit.

In this case, at the same time with termination of striking to the striking portion 40, the striking portion 40 is returned to an original position by a restoring force of the elastic spring 50 installed in the straight shaft 44.

The display unit is positioned at a location adjacent to the striking portion 40. The display unit has an input unit, and an input operation can be manually/automatically performed. As described above, a striking mode of various methods according to a program can be set at the input unit, and various data such as a striking time period, the number of times of striking, a striking speed, a weight upon striking, a time change amount upon striking, an impact amount, and an impact force are previously input and set.

When data are input to the input unit, in the display unit, a reference value is displayed with a numeral or a lamp, and a user can perform a striking mode of an initial state according to a preset value. Thereafter, when a predetermined striking time period is terminated or when a striking exercise is terminated, exercise results such as a time, a striking speed, the number of times of striking, a weight upon striking, a time change amount upon striking, an impact amount, and an impact force are displayed in the display unit. If a performed result of a striking mode of an initial state is satisfied, a striking mode of a next step is performed, and if a performed result of a striking mode of an initial state is not satisfied, a striking mode of an initial state is again performed.

In this way, striking is performed according to a preset mode and thus striking is repeatedly performed and striking of a next stage is performed according to the result.

In the above process, after the kick exercise apparatus 10 according to an exemplary embodiment of the present invention is installed, the user can adjust a striking exercise amount according to a reference value that is set to the input unit, and as data of the striking exercise are displayed with numerals in a display unit, the user can easily recognize striking strength, accuracy of striking, a striking speed, the number of times of striking, a weight upon striking, a time change amount upon striking, an impact amount, and an impact force.

Although embodiments have been described with reference to a number of illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A kick exercise apparatus, comprising:

a body formed with a rectangular parallelepiped frame;

an upper cover and a lower cover for protecting the body at an upper part and a lower part of the body;

striking portions installed at an upper part and a lower part of both sides of the body, each of said striking portions having a plate; and an impact absorption member installed at an outer surface of the plate of the striking portion, wherein one end of a moving portion of a straight shaft in which a rack gear is formed is coupled to an inner center of the plate, one end of a guide plate in which a long hole is formed is coupled to a hinge rib of one of both sides of an upper part and a lower part of the plate, the long hole of the guide plate is inserted into and is moveably coupled to a guide rib of the body, the straight shaft is inserted into and coupled to a bushing coupled to the body, the rack gear is installed to engage with a pinion gear of a rotation shaft installed in the body, an elastic spring is installed around the straight shaft between the body and the plate, and a rear frame of the body is coupled to a gravity center frame.

2. The kick exercise apparatus of claim 1, wherein a sensor is fixedly installed by a fixing volt at one side of the body in which the rotation shaft is installed.

3. The kick exercise apparatus of claim 2, wherein the sensor is connected to a controller, the controller is connected to a display unit and an input unit, and in the input unit, various data of a time, a striking speed, the number of times of striking, a weight upon striking, a time change amount upon striking, an impact amount, and a impact force are set, and the display unit distinguishably displays measured values of striking applied to the striking portion.

4. A kick exercise apparatus, comprising:

a body formed with a rectangular parallelepiped frame;

an upper cover and a lower cover for protecting the body at an upper part and a lower part of the body;

striking portions installed at an upper part and a lower part of both sides of the body, each of said striking portions having a plate; and an impact absorption member installed at an outer surface of the plate of the striking portion, wherein one end of a moving portion of a straight shaft in which a rack gear is formed is coupled to an inner center of the plate, one end of a guide plate in which a long hole is formed is coupled to a hinge rib of one of both sides of an upper part and a lower part of the plate, the long hole of the guide plate is inserted into and is moveably coupled to a guide rib of the body, the straight shaft is inserted into and coupled to a bushing coupled to the body, the rack gear is installed to engage with a pinion gear of a rotation shaft installed in the body, an elastic spring is installed around the straight shaft between the body and the plate, and a rear frame of the body is coupled to a front frame of a treadmill.

5. The kick exercise apparatus of claim 4, wherein a sensor is fixedly installed by a fixing volt at one side of the body in which the rotation shaft is installed, the sensor is connected to a controller, and the controller is connected to a display unit and an input unit, and in the input unit, various data of a time, a striking speed, the number of times of striking, a weight upon striking, a time change amount upon striking, an impact amount, and an impact force are set, and the display unit distinguishably displays measured values of striking applied to the striking portion.

6. The kick exercise apparatus of claim 5, wherein at a left side of the treadmill, a handle having an angle adjustment button in an upper part of the treadmill is installed, a vertical shaft is coupled to a lower part of the handle, a spring is installed between the vertical shaft and a handle portion, and at a right side of the treadmill, a handle having a treadmill on/off button and a front-rear movement button at an upper part of the treadmill is installed, a vertical shaft is coupled to a lower part of the handle, and a spring is installed between the vertical shaft and the handle portion.

7. The kick exercise apparatus of claim 6, wherein an upper rail is installed in an upper part of the treadmill, a roller of a support shaft is inserted into a guide groove of the upper rail, a ring is installed at both sides of a support plate coupled to the support shaft, and a safety line is connected to the ring and is connected to both sides of a protective vest.

* * * * *